US007237742B2

(12) United States Patent
Leins et al.

(10) Patent No.: US 7,237,742 B2
(45) Date of Patent: Jul. 3, 2007

(54) THREAD FEEDING DEVICE COMPRISING A SPRING STOP FOR THREAD DETECTORS

(75) Inventors: Eberhard Leins, Horb (DE); Attila Horvath, Freudenstadt (DE); Richard Kaufmann, Freudenstadt (DE)

(73) Assignee: Memminger-IRO GmbH, Dornstetten (DE)

( * ) Notice: Subject to any disclaimer, the term of this patent is extended or adjusted under 35 U.S.C. 154(b) by 87 days.

(21) Appl. No.: 10/469,014

(22) PCT Filed: Feb. 8, 2002

(86) PCT No.: PCT/DE02/00475

§ 371 (c)(1),
(2), (4) Date: Feb. 23, 2004

(87) PCT Pub. No.: WO02/068742

PCT Pub. Date: Sep. 6, 2002

(65) Prior Publication Data

US 2004/0154340 A1 Aug. 12, 2004

(30) Foreign Application Priority Data

Feb. 26, 2001 (DE) ..... 101 09 143
Mar. 19, 2001 (DE) ..... 101 13 184

(51) Int. Cl.
*B65H 59/10* (2006.01)

(52) U.S. Cl. ..... 242/419.1; 242/365.1

(58) Field of Classification Search ..... 242/365.1, 242/419.1; 226/11; 66/132 R, 146, 163
See application file for complete search history.

(56) References Cited

U.S. PATENT DOCUMENTS

| | | | | |
|---|---|---|---|---|
| 2,169,699 | A | 8/1939 | Cloutier et al. | |
| 2,534,459 | A | 12/1950 | Lawson | |
| 3,883,083 | A * | 5/1975 | Rosen | 242/364.5 |
| 4,106,713 | A * | 8/1978 | Jacobsson | 242/364.5 |
| 4,114,823 | A * | 9/1978 | Fecker et al. | 242/364.5 |
| 4,361,292 | A * | 11/1982 | Fecker et al. | 242/364.5 |
| 6,015,109 | A * | 1/2000 | Ohlson et al. | 242/364.7 |
| 6,102,320 | A * | 8/2000 | Chen | 242/365.6 |

(Continued)

FOREIGN PATENT DOCUMENTS

GB 1348481 A 3/1974

*Primary Examiner*—Patrick Mackey
*Assistant Examiner*—William E. Dondero
(74) *Attorney, Agent, or Firm*—Leydig, Voit & Mayer, Ltd.

(57) ABSTRACT

The yarn feeder device (1) of the invention has one or more yarn feeler levers (26), which are movably supported on the housing (2). The yarn feeler lever (26) is movable between an operating position I and a response position II. In the operating I, its crossbar (28) which forms the yarn feeler means is approximately in the same line as yarn guide elements, such as the struts (19, 23) of yarn guide bails (18, 22). Somewhat above its operating position I, the yarn feeler lever (26) meets a stop, past which it is not moved by the yarn (8). To improve the accessibility to the yarn guide elements (19, 23) particularly when yarn is being inserted and threaded in, the stop of the yarn feeler lever (26) is embodied as yielding. The yarn feeler lever (26) can therefore be moved upward manually past the stop on its lower end (28), in order to open up the space enclosed between the yarn guide elements (19, 23).

8 Claims, 7 Drawing Sheets

U.S. PATENT DOCUMENTS 6,202,450 B1 * 3/2001 Chen ..... 66/132 R
6,616,079 B1 * 9/2003 Leins et al. ..... 242/365.6
6,637,693 B1 * 10/2003 Kaufmann et al. ..... 242/365.7
6,702,218 B1 * 3/2004 Schmodde et al. ..... 242/366

* cited by examiner

THREAD FEEDING DEVICE COMPRISING A SPRING STOP FOR THREAD DETECTORS

FIELD OF THE INVENTION

The present invention relates to a yarn feeder device such as for a knitting machine.

BACKGROUND OF THE INVENTION

Yarn feeder devices are known that have a yarn feed wheel with yarn wrapped around it, which serves on the one hand to continuously draw a yarn off from a yarn bobbin and on the other to furnish this yarn to a yarn-consuming station, such as a knitting machine. Such yarn feeder devices have a retainer or base body on which a yarn feed wheel is rotatably supported with a preferably vertical pivot shaft. The yarn feed wheel is supported by the shaft and is driven via pulleys disposed on the other side of the shaft. Both along the way to the yarn feed wheel and on the way from the yarn feed wheel, the yarn is passed through yarn guide elements, such as eyes.

For checking whether yarn is present or not, a so-called yarn feeler is often present. This is a lever that is pivotably supported on the base body or retainer and has a free end that bears down on the yarn. If the yarn sags or tears, the lever moves out of its operating position and a warning light is turned on, for instance. This is the response position.

As a rule, the yarn feeler lever is located on the yarn in the vicinity of a yarn guide element that keeps the yarn at a defined height. When the yarn is being threaded in, it must be guided through the yarn guide element. When this is done by hand, the yarn feeler lever often can be an obstacle if the lever is located next to the yarn guide element. On the other hand, during operation of the yarn feeder device, the yarn feeler lever must be prevented from skipping or fluttering on the yarn traveling through it. Otherwise, the function of the yarn feeder device could be impaired.

SUMMARY OF THE INVENTION

In view of the foregoing, it is an object of the invention to create a yarn feeder device that functions reliably and is easier to manipulate.

The yarn feeder device of the invention attains this object. To that end, the yarn feeder device is assigned a stop mechanism that limits the travel of the yarn feeler mechanism in or immediately next or adjacent to the operating position, and the stop mechanism is yieldable. The yieldingness is dimensioned such that the forces acting on the yarn feeler mechanism during normal operation are unable to overcome the limit set by the stop mechanism, which thus acts as a fixed stop. However, if a yarn is to be inserted into the yarn feeder device, then the yarn feeler mechanism can be pressed upward beyond the operating position. This gives the yarn guide element enough clearance that the yarn can easily be guided by hand there through. The stop mechanism is accordingly designed such that the limit it presents to the range of motion can easily be overcome with the forces brought to bear by hand in threading the yarn, while for the comparably much lesser forces that the yarn is capable of exerting, the stop mechanism is virtually rigid.

The stop mechanism is preferably a resilient stop mechanism. The resilient yieldingness can be attained in fundamentally different ways. In a first embodiment, the yarn feeler mechanism, such as an eye or part of a wire bail that rests on the yarn, is held by a rigid, pivotably supported lever, and the pivoting range is limited by a resilient stop. In another exemplary embodiment the stop is rigid, and the lever itself is resilient. At least in the latter instance, the lever forms part of the yieldingly embodied stop mechanism for the yarn feeler mechanism.

If the lever arm for the stop mechanism is resiliently yielding, a very simple, robust embodiment can be provided. The other embodiment with the rigid lever and spring stop for it, however, may have somewhat improved manipulability.

The resilient stop mechanism can be formed by a leaf spring, tension spring, or compression spring. A leaf spring is preferred, which cooperates for instance with a cam that is connected so as to be fixed against rotation relative to the lever that supports the yarn feeler mechanism. The spring and the cam can be shaped and disposed such that between the operating position and the response position of the yarn feeler mechanism, a moment that affects the pivoting of the lever does not occurs. This can also be achieved if the spring, such as a leaf spring, rests permanently on a cylindrical surface of the cam, for instance in order to prestress the bearing of the lever in one direction. Thus, the bearing can be free of any play.

For the spring, a prestressed spring is preferably used. Prestressing can be attained for instance by providing that a spring, such as a leaf spring, associated with a cam and which rests in a prestressed condition on an abutment so that normally the spring does not touch the cam. The spacing between the spring and the cam is selected such that the cam touches the spring when the yarn feeler lever is raised beyond its operating position. Thus, a corresponding rotation of the cam is not possible until a torque that overcomes the spring prestressing is exerted. Thus, there is an abrupt change in the characteristic curve of the restoring torque. As a result, the spring stop, for yarn forces occurring during operation, functions like a fixed stop. Manually, however, the stop can easily be overcome—especially once the prestressing force is overcome—so no further substantial increase in force or substantial increase in the contrary torque occurs any longer. On the contrary; this moment can drop again.

The "hard" limitation of the pivoting range of the yarn feeler lever, that is, the limitation that is unyielding even to relatively strong forces, is preferably effected by a special stop that is separate from the resilient stop mechanism. This special stop can be attained for instance by a yarn guide element or its retainer. The separation of the resilient stop mechanism and the nonresilient stop mechanism has the advantage that overload of the resilient stop mechanism can be avoided easily.

The resilient stop comes into play in a position that is only slightly above the operating position. This is a position in which the yarn rests on the yarn guide element at an angle of virtually 180°. In other words, this is the position in which a yarn extends between two yarn guide elements essentially taut (straight), that is, with the desired yarn tension, when the yarn feeler mechanism is bearing down on it.

Bails that, in a preferred embodiment, are open at least downstream of the yarn feed wheel serve as the yarn guide elements. Initially, they guide the yarn only in the manner of a supporting surface; above that, the yarn could be lifted from the corresponding supporting surfaces. However, this is prevented by the yarn feeler lever, which at least in regular operation holds the yarn down and thus guides it on the support surface of the yarn guide element. Thus the yarn feeler lever takes on a guidance function. In this way, despite the open design of the yarn guide element in the form of an open bail, erratic yarn travel (such as skipping, fluttering and the like) is avoided. In terms of yarn guidance, the open yarn elements in conjunction with the yarn feeler lever are thus at least equivalent to closed yarn guide eyes. However, precisely because of the open design and the possibility of lifting the yarn feeler lever by force beyond its operating position, yarns can be threaded in much more easily.

Further details of advantageous embodiments of the invention can be learned from the ensuing description of the drawings.

In the drawings, exemplary embodiments of the invention are illustrated.

DETAILED DESCRIPTION OF THE INVENTION

Figure 1:
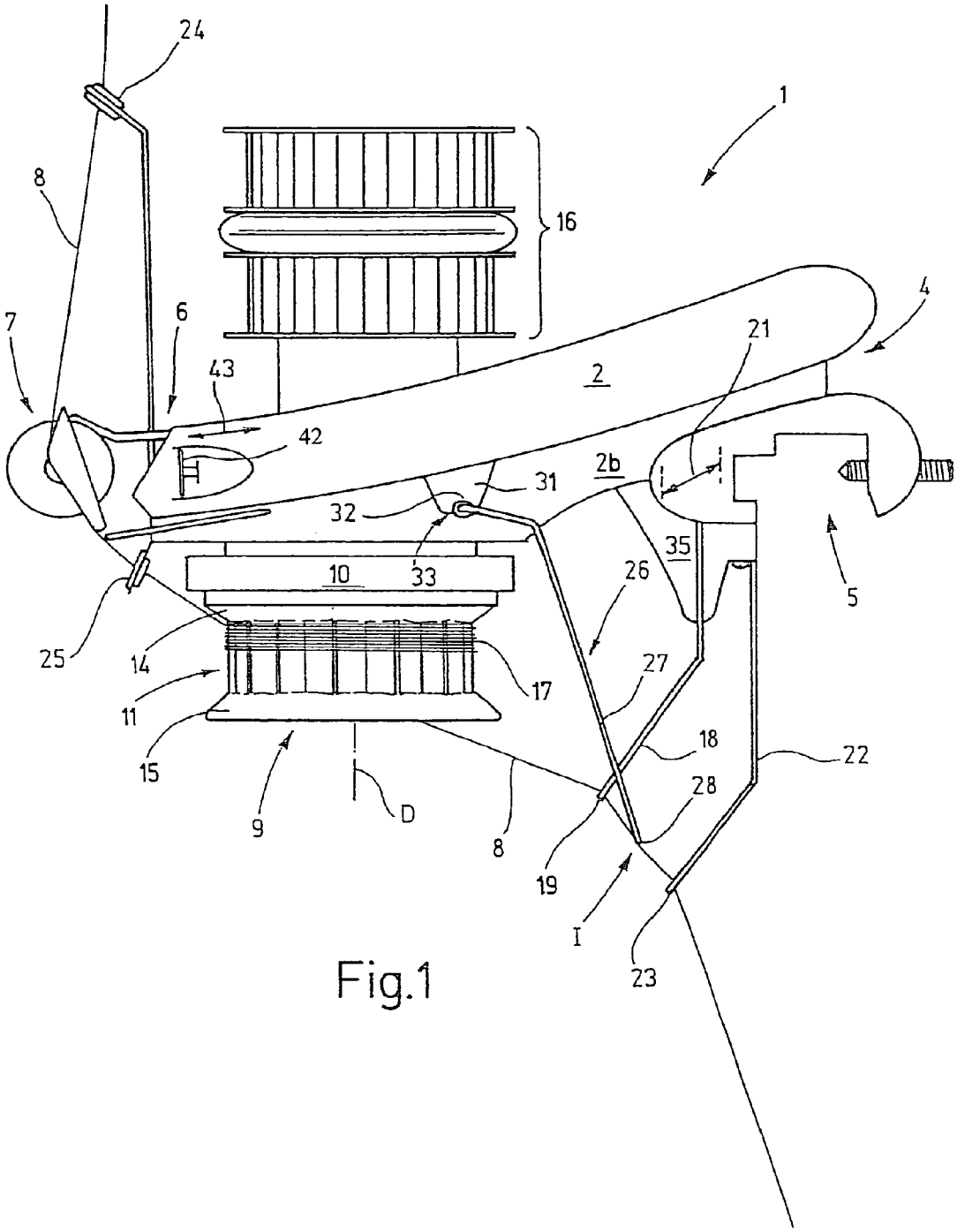
FIG. 1 is a side view of an exemplary yarn feeder device according to the present invention showing the yarn feeler lever of the yarn feeder in an operating position.

In FIG. 1, a yarn feeder device 1 is shown whose housing 2 is embodied as a central bearer. On one end 4, the housing is provided with a fastening clamp 5 for fastening to a knitting machine or similar yarn-using machine, while on the opposite end 6, a yarn brake 7 is disposed. This yarn brake serves by nonpositive engagement to brake a yarn 8 traveling through.

Between the two ends 4, 6, there is a vertical shaft, which is supported rotatably in the housing 2 about a rotary axis D, and on its lower end it has a yarn feed wheel 9, which has a ring 10 on the top. This ring is preferably embodied as a deep-drawn sheet-metal part. The outer circumferential face 11 of the ring is closed and profiled, while the upper and lower edges 14, 15 are each conically shaped. One or more pulleys 16, which above the housing 2 are connected to the shaft, are used to drive the yarn feed wheel 9.

The yarn feed wheel 9 forms an advancement device that serves to advance the yarn 8 in accordance with a specified value. The specified value comprises the rpm at which the yarn feed wheel is driven. The yarn 8, to that end, wraps around the yarn feed wheel 9 in a plurality of windings and forms a lap 17 on the yarn feed wheel 9. To deliver the yarn 8 to the yarn feed wheel 9 in a defined way and thus to the Lap 17, and to guide the yarn 8 downward from the yarn feed wheel 9 in a controlled manner, one or more yarn guide elements are provided. These include at least one yarn guide bail 18, which the yarn 8 passes through immediately after being paid out from the yarn feed wheel 9. The yarn guide bail 18 in this case is in the form of a substantially U-shaped wire bail, with two legs joined together via a crossbar 19. The crossbar 19 guides the yarn 8. The crossbar is approximately straight and is disposed at a right angle to the rotary axis D of the yarn feed wheel 9. Alternatively, a yarn outlet eye or a similar element may be provided as the yarn guide element. However, an open yarn guide bail has the advantage that the yarn 8, depending on the direction of rotation of the yarn feed wheel, is guided on one of the ends of the crossbar 19 so that in both directions, well-defined conditions of paying out the yarn from the yarn feed wheel 9 result. The yarn guide bail 18 can be disposed relatively close to the yarn feed wheel 9. To guard against wear, the yarn guide bail 18 can have a ceramic overlay. The crossbar 19 also can be made entirely of ceramic, if necessary. When the yarn guide element consists of an open yarn guide bail 18, there is only a very slight tendency for fluff or other dust to deposit on the yarn guide element. Hence, there is no need to fear clogging.

Conversely, when the yarn guide element consists of an eye, there is the advantage that the guide element can be a simple ceramic element. In that case, the tendency to clog up may be somewhat higher.

To make it possible to establish various operating states, the yarn guide element (i.e., the yarn guide bail 18) preferably is adjustable supported. To that end, both legs of the yarn guide bail 18 are enclosed in a sliding block guide, for instance, which permits an adjustment of the yarn guide element approximately in a range represented by an arrow 21 in FIG. 1 in the appropriate direction.

For further guidance of the yarn 8, further yarn guide elements can be provided. These include for instance a yarn guide bail 22, which is disposed following the yarn guide bail 18. The yarn guide bail 22 is retained by one leg on the yarn feeder device 1 and is comparatively narrower than the yarn guide bail 18. The crossbar 23 of the yarn guide bail 22 is rounded in a semicircular shape.

On the inlet side (in terms of the travel of the yarn 8, before the yarn feed wheel 9), further yarn guide elements in the form of yarn inlet eyes 24, 25 may be provided on both sides of the yarn brake 7. These eyes can be embodied as ceramic eyes, for instance, which are retained on suitable retainers and are connected to the housing 2.

A yarn feeler lever 26 is pivotably supported on the housing 2. The yarn feeler lever 26 in this instance is a two-legged wire bail, whose legs 27 fit laterally over the yarn guide bail 18. On the lower end, that is, the end remote from the pivotable bearing, the legs 27 are joined together by a crossbar 28, which weighs down on the yarn 8. The crossbar 19 and the crossbar 28 form a yarn guide eye that guides the yarn at the top and bottom. The crossbar 28 together with the crossbar 23 in turn forms a yarn guide eye that guides the yarn at the top and at the bottom. The eyes thus formed consist of overlapping open elements. By exerting extra pressure on the yarn feeler lever 26 beyond its operating position I shown in FIG. 1, these eyes can be opened to a certain extent for threading the yarn.

Figure 4:
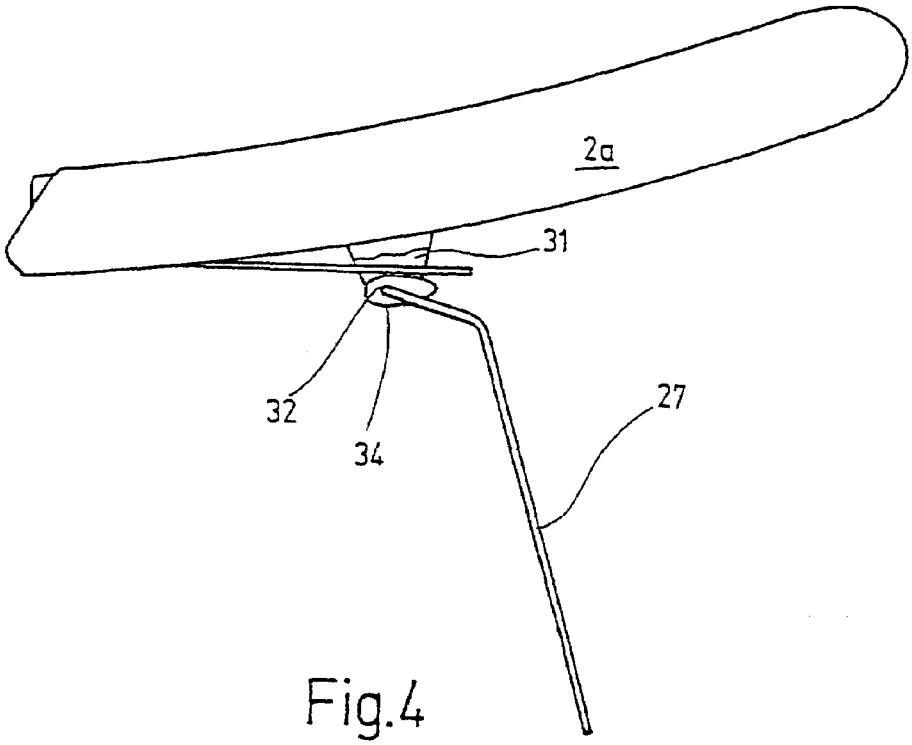
FIG. 4 is a side view of the yarn feeler lever of the yarn feeder device of FIG. 1.

The pivotable bearing of the yarn feeler lever 26 is in the housing 2 as shown separately in FIG. 4. The housing 2 comprises an upper housing part 2*a* (FIG. 4) and a lower housing part 2*b* (FIG. 1). The upper housing part 2*a* has extensions 31, which on their underside each have a notch 32 for receiving inward-bent ends of the legs 27 of the yarn feeler lever 28. The ends of the legs 27 thus form a kind of shaft. For defining a bearing support for this shaft, a recess 33 is provided in the lower housing part; it is adapted in shape to the extension 31 and together with the notch 32 forms a bearing opening. The inward-bent ends of the legs 27 are joined to one another by a molded plastic body 34.

Figure 2:
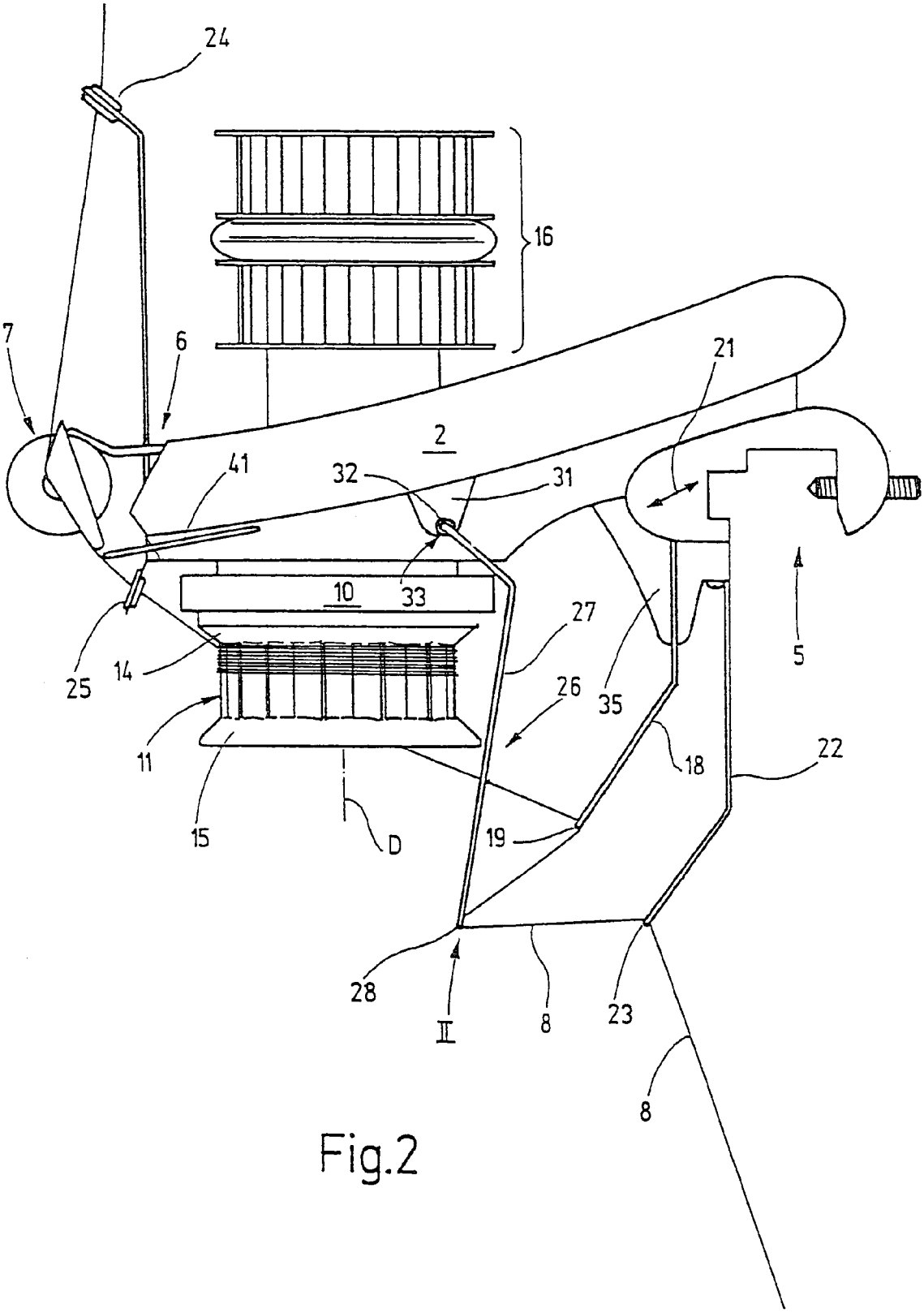
FIG. 2 is a side view of the yarn feeder device of FIG. 1 showing the yarn feeler lever of the yarn feeder in a response position.

Because of the pivotable bearing of the yarn feeler lever 26, its crossbar 28, which forms a yarn feeler mechanism, can be pivoted by its own weight out of the position shown in FIG. 1 into the position shown in FIG. 2, if allowed by the yarn 8. In the FIG. 2 position, an appropriate switch device can respond to the shifting in position of the yarn feeler lever 26 and for instance switch on a light 35. The position II shown in FIG. 2 for the yarn feeler lever 26 is therefore the response position, while the position I shown in FIG. 1 exists during normal operation and is thus called the operating position. The pivoting range of the yarn feeler lever 26 includes at least both positions I and II. Within this range, the yarn feeler lever 26 is easily movable.

In position I, the crossbar 28 is approximately in a line with the crossbars 19, 23. The yarn 8 traveling through the two yarn guide bails 18, 22 and under the crossbar 28 is thus nearly, or even completely, taut.

Figure 5:
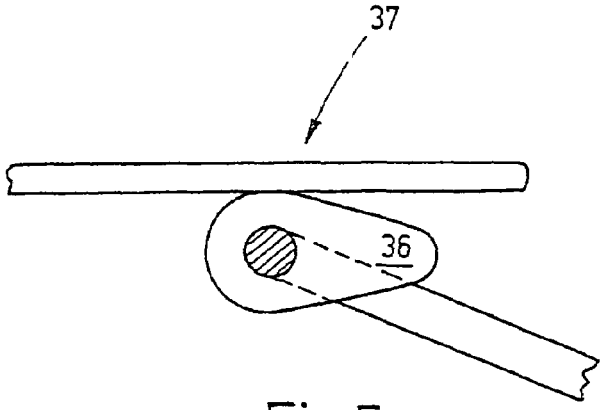
FIG. 5 is a schematic side view of a resilient stop mechanism for the yarn feeler lever of the yarn feeder device of FIG. 1.
Figure 6:
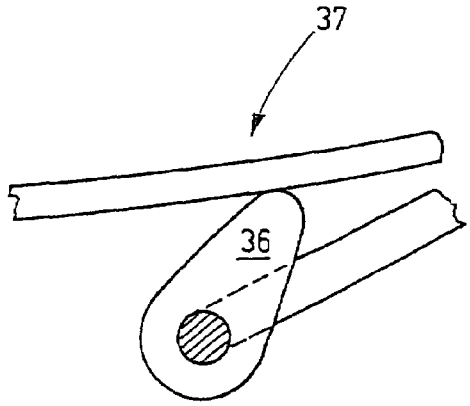
FIG. 6 is a schematic side view of the resilient stop mechanism and yarn feeler lever of FIG. 5 showing the stop mechanism in a different operating position.

At the crossbar 28, the yarn traverses an angle of approximately 160 to 180°. To prevent the yarn feeler lever 26 from skipping or fluttering on the yarn traveling through, there is a predetermined stop above its operating position I. This stop is formed by a cam 36, shown in FIGS. 5 and 6, provided for instance on a molded plastic body 34. This cam is connected so as to be fixed against rotation relative to the yarn feeler lever 26 and cooperates with a spring 37. The spring may be a leaf spring, for instance, and is joined at one end solidly to the housing 2 (in particular to the upper housing part 2*a*). The leaf spring 37, in the vicinity of its free end, rests on the cam 36 and tenses the inward-bent ends of the legs 27 toward the recess 33 of the lower housing part 2b (FIG. 1). Play-free support of the yarn feeler lever 26 is thus achieved.

Between its two curved regions, the cam 36 has at least one straight or flattened region, which in the position III (FIG. 8) rests flatly on the leaf spring 37. The cam 36 is calibrated such that it does not begin to deflect the spring 37 until the yarn feeler lever 26 has pivoted upward beyond its operating position I. The cam 36 deflects the spring 37 in the process, as shown in FIG. 6.

Figure 6A:
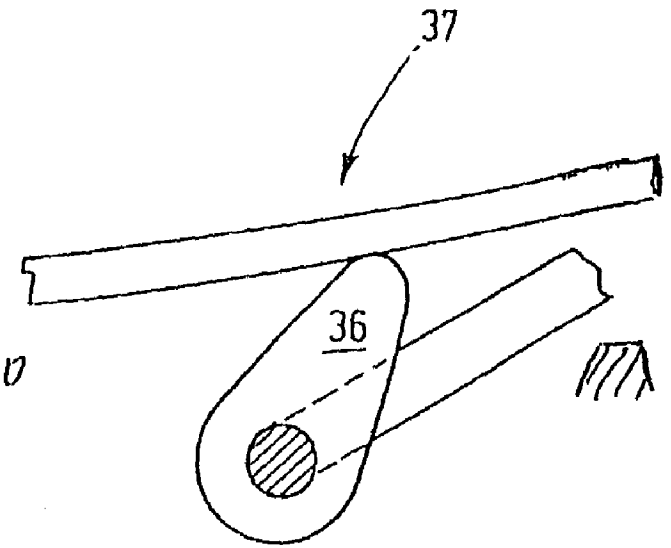
FIG. 6A is a schematic side view of the resilient stop mechanism and yarn feeler lever of FIG. 5A showing the stop mechanism in a different operating position.
Figure 5A:
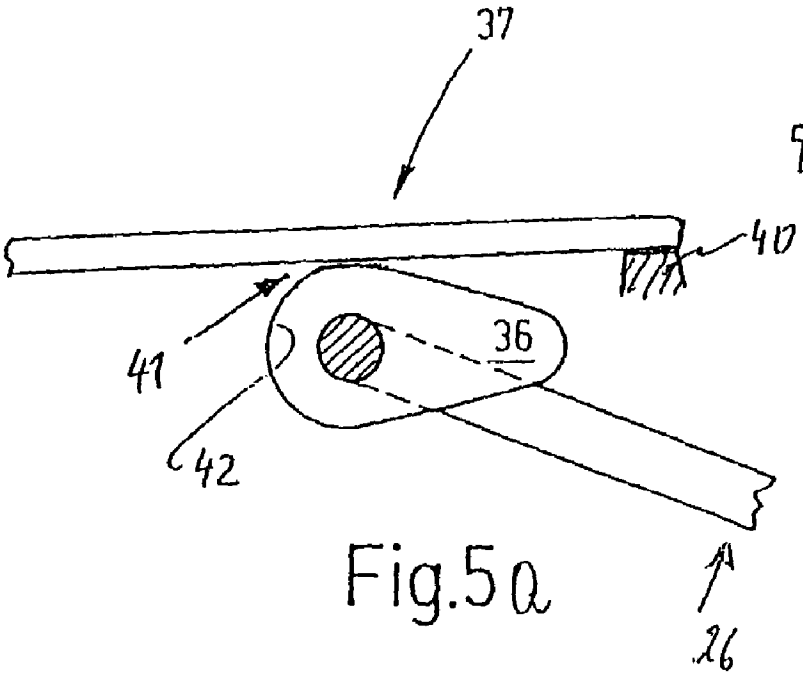
FIG. 5A is a schematic side view of an alternative resilient stop mechanism for the yarn feeler lever of the yarn feeder device of FIG. 1.

In FIG. 5*a*, a modified embodied of the spring means is shown that has been conceived in particular with a view to especially low-friction support of the yarn feeler lever 26 and an especially steep or stepped rise S (FIG. 8) of the characteristic curve of the spring. In the embodiment of FIG. 5*a*, the leaf spring 37 is retained at one end. The spring extends past the cam 36 and rests resiliently under prestressing on a fixed abutment 40. The abutment 40 can be embodied as a protrusion in the housing both between the cam 36 and the fixed bearing of the spring 37 or, alternatively, on the opposite side or on both sides, as shown in FIGS. 5*a* and 6*a*. The abutment 40 is disposed such that between the leaf spring 37 and the part of the cam 36 near the axis, a slight gap 41 remains, so that the leaf spring 37 does not contact the cam 36. Hence the leaf spring 37 does not press against the cam 36. In terms of its size, the gap 41 is dimensioned such that no matter what are the given production tolerances, the gap is greater than 0, and contact between the leaf spring 37 and the cam 36 is avoided.

If the yarn feeler lever 26 is lifted beyond its operating position, the nose or protrusion of the cam 36 touches the leaf spring 37. This protrusion initially acts as a stop for the cam 36. Not until the torque acting on the cam 36 is so great that the prestressing force of the leaf spring 37 can be overcome is the spring lifted from the stop 40, whereupon the cam 36 can rotate onward. The result is the stepped course of the characteristic curve shown in FIG. 8. Once the leaf spring 37 has lifted from its stop 40, the torque exerted on the cam 36 by the leaf spring 37 no longer increases substantially, however. On the contrary; upon further rotation of the cam, by varying the angular relationship between the cam 36 and the leaf spring 37, a certain reduction in the contrary torque can occur upon cam rotation.

To prevent the spring means 37 from touching the cam 36 as long as the yarn feeler lever 26 has not lifted beyond its operating position I, the cam 36 has a circular-arc-shaped circumferential region 42, which extends beyond the total pivot angle within which no contrary force is to be generated. Within this circular-arc region 42, the outer circumferential face of the cam 36 has a constant radius. In the region of the nose of the cam, however, the radius is increased markedly.

Figure 7:
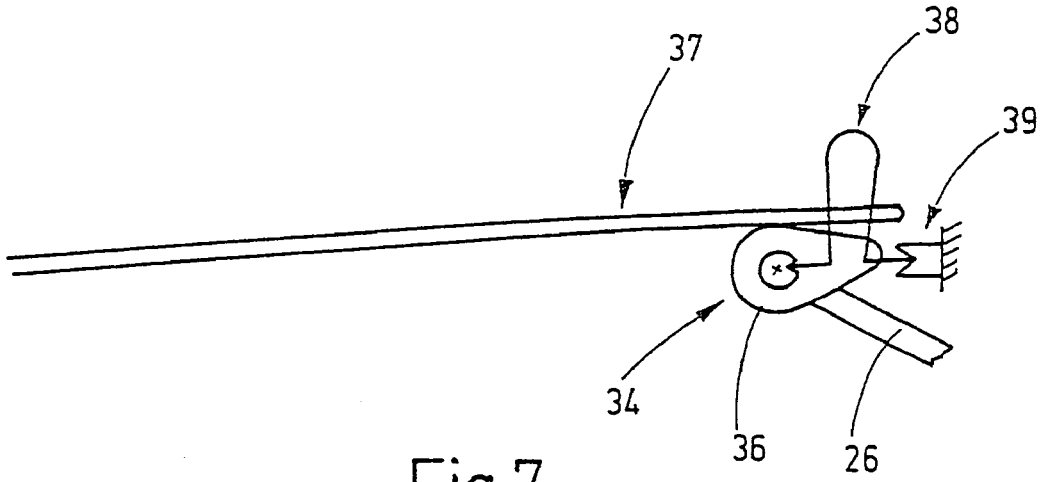
FIG. 7 is a schematic partial side view of a yarn feeler lever for the yarn feeder device having a resilient stop and weight relief mechanism.

In addition, a weight relief spring 38 can be provided, which is shown in FIG. 7. The weight relief spring 38, bent approximately in a horseshoe or a U with legs bent outward, is seated pivotably by one leg in an abutment 39 that is fixed to the housing. Through its other end, it engages a notch provided in the plastic body 34. This notch is calibrated such that in the operating position of the yarn feeler lever 26, the relief spring 38 generates a torque that is oriented counter to the force of the weight of the yarn feeler lever 26. The resultant torque is a slight moment that moves the crossbar 28 downward, so that the crossbar 28 weighs down on the yarn 8 with only a very slight force.

Figure 8:
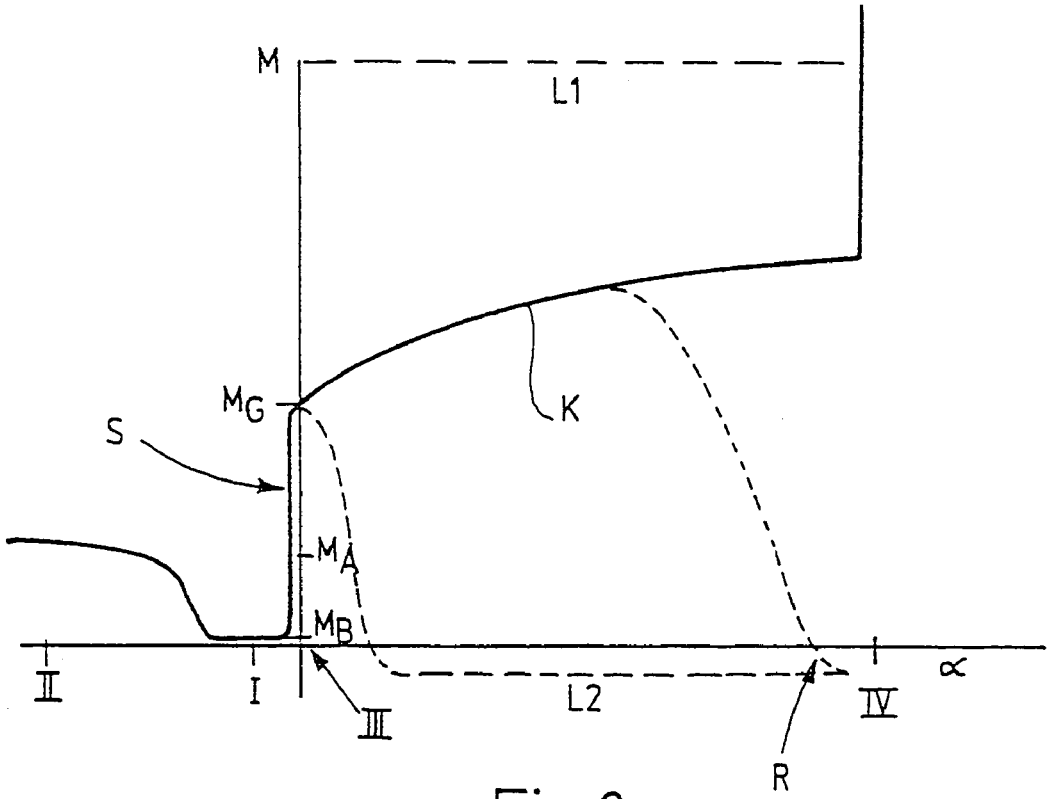
FIG. 8 is a graph showing the torque exerted on a yarn feeler lever according to the invention as a function of its position.

The yarn feeder device 1 described thus far functions as follows:

In operation, the yarn 8 assumes the position shown in FIG. 1. As a result of the rotation of the yarn feed wheel 9, yarn 8 is constantly furnished to the knitting machine. In the process, the yarn 8 passes through the yarn guide bails 18, 22, remaining so taut between them that the yarn feeler lever 26 is retained in its operating position I (shown in FIG. 1). This operating position I is shown on the left, on the abscissa, in the graph of FIG. 8. In this graph, the deflection angle of the yarn feeler lever 26 is shown with a positive direction counterclockwise. If the yarn tension decreases, the yarn feeler lever 26 can pivot downward somewhat. In the graph of FIG. 8, this corresponds to a motion to the left on the abscissa. The weight relief spring 38 in the process passes through its dead center point, so that then it additionally acts to drive the yarn feeler lever 26 clockwise. The torque MA that acts on the crossbar 28 increases in the process.

In the operating position I, the torque exerted by the weight relief spring 38 is counter to the force of weight, so that the resultant torque $M_B$ is very slight.

If the yarn feeler lever 26 is lifted counterclockwise beyond its operating position I, then the nose of the cam 36 comes into contact with the leaf spring 37, so that suddenly a comparatively high torque $M_G$ in the clockwise direction occurs. Thus the course of the overall characteristic curve of the spring, in a position III located somewhat above the operating position I, has a step S. which for normal operation of the yarn feeler lever 26 functions like a fixed stop. The contrary moment $M_G$, however, is not so great that it cannot be overcome by hand. It allows further counterclockwise pivoting of the yarn feeler lever 26, when the yarn feeler lever 26 is lifted by hand beyond the position III. The further course of the characteristic angle/torque curve (or characteristic force-travel curve) K is relatively arbitrary. It suffices if the characteristic curve remains in a region bounded by dashed lines L1, L2 in FIG. 8. The force or the torque can, if desired, remain positive; however, it can also become negative, in order to define an upper detent position (marked R in FIG. 8). The step S can, as shown, mean an abrupt change in the course of the contrary torque. However, even a steeply rising portion of the characteristic curve often suffices.

Figure 3:
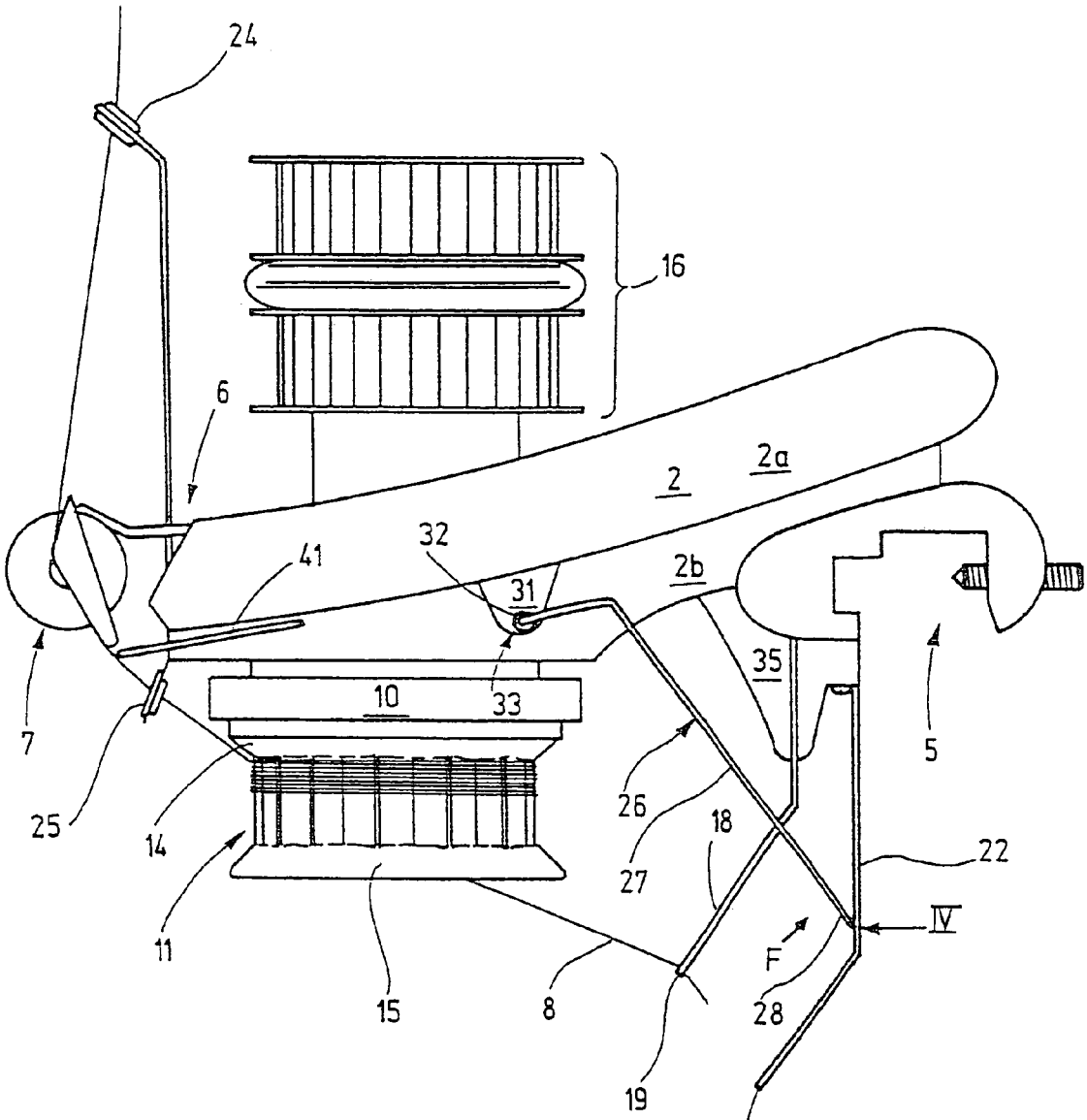
FIG. 3 is a side view of the yarn feeder device of FIG. 1 after the yarn has been threaded.

As a result of the resilient stop means, formed by the cam 36 and the spring 37, for the crossbar 28 serving as a yarn feeler element, a stop for the yarn feeler lever 26 that prevents skipping or fluttering of the yarn feeler lever 26 is defined. On the other hand, the yarn feeler lever 26 can be moved by hand until it strikes the leg of the yarn guide bail 22. This is shown in FIG. 3. The position is marked IV and is marked accordingly in FIG. 8. In this position, the yarn 8 can be guided especially well by the yarn guide bails 18, 22 and thus threaded in. In the process, the yarn feeler lever 26 is kept in its position Ill IV by a force F that is to be exerted by hand. The space between the two yarn guide elements 18, 22 is free and thus accessible by hand.

A similar provision can be made for an inlet yarn feeler 41, which may be provided between the yarn brake 7 and the yarn inlet eye 25. This yarn inlet feeler 41 is likewise supported pivotably on the housing 2.

In addition, a manually actuated feeler block 42 (FIG. 1) may be provided. It can comprise a slide upon whose actuation the yarn feeler lever 26 remains held in its operating position I without dropping into it response position II. The feeler block 42 can be displaced back and forth in the direction of the arrow 43 in order to activate or deactivate the yarn feeler lever 26. It is also possible to embody the feeler block 42 in such a way that it transfers the yarn feeler lever 26 upon actuation into its position IV. In such an embodiment, it is then no longer necessary to restrain the yarn feeler lever 26 in its position IV as the yarn 8 is threaded in.

Figure 9:
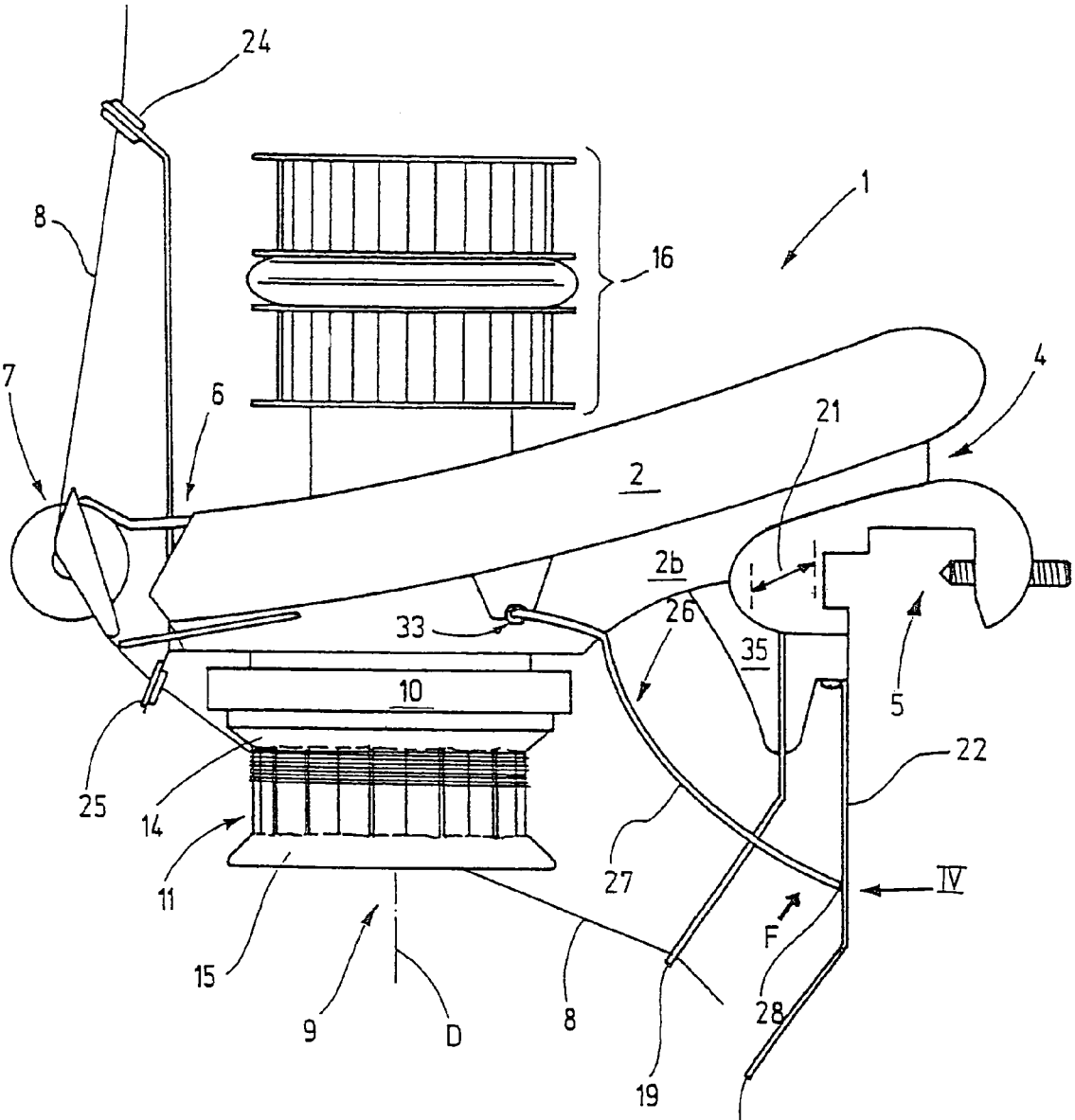
FIG. 9 is a side view of an alternative embodiment of a yarn feeler device and yarn feeler lever with the yarn feeler lever in the threading position.

A further-modified embodiment of the yarn feeder device is shown in FIG. 9. While in the embodiments described above the resiliently yielding stop mechanism for the crossbar 28 has been formed via the rigid legs 27 of the yarn feeler lever 26, which is rigid overall, and the spring arrangement shown in FIGS. 5 and 6, the resilient stop means in the embodiment of FIG. 9 is formed by what here are resiliently flexible legs 27 of the yarn feeler lever 26. The crossbar 28 is retained via the resilient legs 27, and a rigid stop is assigned to the yarn feeler lever 26 in the bearing device. The yarn feeler lever 26 can be transferred by hand by a force F into its position IV, in which the crossbar 28 is in contact with the leg of the yarn guide eye 22.

The yarn feeder device 1 of the invention has one or more yarn feeler lever 26, which are movably supported on the housing 2. The yarn feeler lever 26 is movable between an operating position I and a response position II. In the operating position I, its crossbar 28 which forms the yarn feeler means is approximately in line with yarn guide elements, such as the struts 19, 23 of yarn guide bails 18, 22. Somewhat above its operating position I, the yarn feeler lever 26 meets a stop past which the yarn 8 does not move it. To improve accessibility to the yarn guide elements 19, 23 particularly when yarn is being inserted and threaded in, the stop of the yarn feeler lever 26 is embodied as yielding. The yarn feeler lever 26 can therefore be moved upward manually past the stop on its lower end 28, in order to open up the space enclosed between the yarn guide elements 19, 23.

What is claimed is:

1. A yarn feeder device for knitting machines comprising:

a yarn conveyor for advancing yarn to the knitting machine;

at least one yarn guide element for guiding the yarn advanced by the yarn conveyor;

a feeler mechanism disposed beside the at least one yarn guide element and supported for movement between an operating position bearing against yarn being advanced to said knitting machine and a retracted inoperative position;

a yielding stop mechanism associated with the yarn feeler mechanism for limiting motion of the yarn feeler mechanism when the yarn feeler mechanism is in or adjacent the operating position, said stop mechanism including a cam connected to a lever arm of said yarn feeler mechanism and a spring disposed adjacent said cam, an abutment against which said spring is prestressed when said yarn feeler mechanism is in said operating position, and said spring being liftable from said abutment by said cam in response to movement of said yarn feeler mechanism to said retracted inoperative position.

2. A yarn feeder device for knitting machines comprising:

a yarn conveyor for advancing yarn to the knitting machine;

at least one yarn guide element for guiding the yarn advanced by the yarn conveyor;

a yarn feeler mechanism disposed beside the at least one yarn guide element and supported for movement between an operating position bearing against yarn being advanced to said knitting machine and a retracted inoperative position;

a yielding stop mechanism associated with the yarn feeler mechanism for limiting motion of the yarn feeler mechanism when the yarn feeler mechanism is in or adjacent the operating position, said stop mechanism including a cam connected to a lever arm of said yarn feeler mechanism and a spring disposed adjacent said cam, and said spring and cam defining a force-travel curve which has a step while in the operating position of the yarn feeler mechanism.

3. The yarn feeder device of claim 2, wherein the spring and the cam define a gap with one another when the yarn feeler mechanism and the associated lever arm are located below the operating position.

4. A yarn feeder device for knitting machines comprising:

a yarn conveyor for advancing yarn to the knitting machine;

at least two yarn guide elements for guiding the yarn advanced by the yarn conveyor;

a yarn feeler mechanism disposed between two yarn guide elements and supported for movement between an operating position bearing on yarn being advanced by the conveyor to the knitting machine, a response position below the operating position for sensing a brake or slacking of the yarn, and a retracted inoperable position above and removed from said operating position for enabling unencumbered positioning of yarn with respect to said at least one yarn guide element prior to start up of said yarn feeder device, said yarn feeler mechanism bearing upon said yarn at least under the weight of the yarn feeler mechanism while in said operating position, said yarn feeler mechanism being movable to said response position in response to a breakage or slacking of the yarn being advanced through the yarn feeder device, a stop mechanism associated with said yarn feeler mechanism for limiting upward motion of the yarn feeler mechanism when the yarn feeler mechanism is in the operating position, said stop mechanism including a resilient holding member having sufficient rigidity to maintain the yarn feeler mechanism in said operating position in bearing engagement with yarn being advanced to the knitting machine without skipping and fluttering of the yarn feeler mechanism relative to the moving yarn, and said resilient holding member being overcome by manual lifting of the yarn feeler mechanism to said retracted inoperative position, and said yarn feeler mechanism being disposed between two yarn guide elements and said resilient holding member having a force-travel characteristic curve with a step (S) in the curve disposed at a point at which the yarn is essentially straight between the two yarn guide elements.

5. The yarn feeder device of claim 4, wherein the yarn feeler mechanism is supported by a lever arm that is pivotably supported in a bearing device.

6. The yarn feeder device of claim 5, wherein said lever arm is resiliently yielding for permitting manual movement of said yarn feeler mechanism to said retracted inoperable position.

7. The yarn feeder device of claim 4, wherein said stop mechanism includes a cam that is connected to a lever arm of said yarn feeler mechanism, and a spring disposed adjacent the cam for preventing movement of said yarn feeler mechanism from said operating position to said retracted inoperable position during movement of said yarn to the knitting machine.

8. The yarn feeder device of claim 4, wherein a support of one of the yarn guide elements limits the motion of the yarn feeler means.

* * * * *